US007729631B2

(12) United States Patent
Yamada

(10) Patent No.: US 7,729,631 B2
(45) Date of Patent: Jun. 1, 2010

(54) IMAGE FORMING APPARATUS CAPABLE OF PREVENTING WASTE OF DEVELOPER

(75) Inventor: Ryuji Yamada, Ogaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 297 days.

(21) Appl. No.: 12/027,714

(22) Filed: Feb. 7, 2008

(65) Prior Publication Data

US 2008/0193154 A1 Aug. 14, 2008

(30) Foreign Application Priority Data

Feb. 8, 2007 (JP) ..... 2007-029301

(51) Int. Cl.
*G03G 13/06* (2006.01)

(52) U.S. Cl. ..... 399/85; 399/58; 399/61; 399/82

(58) Field of Classification Search ..... 399/12, 399/53, 59, 61, 75, 82, 85, 222, 224
See application file for complete search history.

(56) References Cited

U.S. PATENT DOCUMENTS 7,218,871 B2 * 5/2007 Ogata ..... 399/27
7,394,998 B2 * 7/2008 Takagi ..... 399/12
2003/0184638 A1 10/2003 Shimomura et al.
2006/0204257 A1 9/2006 Kawano et al.

FOREIGN PATENT DOCUMENTS

| | | |
|---|---|---|
| EP | 168 099 A2 | 1/2002 |
| JP | 6-12005 | 1/1994 |
| JP | 11-125999 | 5/1999 |
| JP | 2006-235237 | 9/2006 |

* cited by examiner

*Primary Examiner*—David P Porta
*Assistant Examiner*—Casey Bryant
(74) *Attorney, Agent, or Firm*—Scully, Scott, Murphy & Presser, P.C.

(57) ABSTRACT

A mode setting portion sets a mode to either one of a normal mode in which a developer amount set value T is set to a base developer amount Tbase and a developer-saving mode in which the value T is set to a value smaller than the base developer amount Tbase based on a saving coefficient S. A parameter obtaining portion obtains both a cumulative number of printed sheets Pttl and a developer remaining amount Rt. A determining portion determines in the developer-saving mode whether a first inequality Rt≦Tbase×Sdef×(Pmax−Pttl) is satisfied. A saving-coefficient setting portion sets the saving coefficient S to a default saving coefficient Sdef if the determining portion determines that the first inequality is satisfied, and sets the saving coefficient S to a value satisfying a second inequality Sdef<S≦Rt/{Tbase×(Pmax−Pttl)} if the determining portion determines that the first inequality is not satisfied.

12 Claims, 12 Drawing Sheets

IMAGE FORMING APPARATUS CAPABLE OF PREVENTING WASTE OF DEVELOPER

CROSS REFERENCE TO RELATED APPLICATIONS

This application claims priority from Japanese Patent Application No. 2007-029301 filed Feb. 8, 2007. The entire content of the priority application is incorporated herein by reference.

TECHNICAL FIELD

The invention relates to an image forming apparatus.

BACKGROUND

A replaceable toner cartridge is used for a laser printer. Such a toner cartridge accommodates a certain amount of toner so that toner is supplied from the toner cartridge to a printing unit for printing. When the toner cartridge runs out of toner, the used toner cartridge is replaced with a new toner cartridge.

Japanese Patent Application Publication No. H11-125999 proposes a laser printer which employs a lower developing bias and a lower laser power than in its normal operation so as to lighten printing density The proposed laser printer provides a toner-saving mode for reducing toner consumption by forcibly thinning out dots (reducing the number of dots). If the toner-saving mode is used to reduce toner consumption, it is possible to delay replacement time for replacing the toner cartridges due to toner exhaustion.

The toner cartridge includes various rotary components such as an agitator for agitating toner and a gear for transferring driving force to the toner cartridge. The replacement time of the toner cartridge is also determined based on lives of the rotary components (a rotation driving time calculated on a predetermined number of pages to be printed, or a maximum time in which the rotary components can be used).

Therefore, even if the toner-saving mode is used to reduce an amount of toner to be consumed, the toner cartridge needs to be replaced when the replacement time based on the lives of the rotary component arrives before toner exhaustion. Hence, the replacement time of the toner cartridge cannot be delayed. Further, toner left in the toner cartridge is wasted when the toner cartridge is replaced due to an end of life of the rotary components.

SUMMARY

In view of the foregoing, it is an object of the invention to provide an image forming apparatus which prevents developer from being wasted.

In order to attain the above and other objects, the invention provides an image forming apparatus. The image forming apparatus includes a main body, a developer accommodating unit, an image forming unit, a mode setting portion, a parameter obtaining portion, a determining portion, and a saving-coefficient setting portion. The developer accommodating unit is configured to accommodate developer and is detachably mounted in the main body. The image forming unit forms an image on a surface of a recording medium with the developer. The mode setting portion sets a mode to either one of: a normal mode in which a developer amount set value T is set to a base developer amount Tbase, the developer amount set value T being an amount of developer consumed for forming an image on a single sheet of the recording medium; and a developer-saving mode in which the developer amount set value T is set to a value smaller than the base developer amount Tbase based on a saving coefficient S, the saving coefficient S being greater than zero and smaller than one. The parameter obtaining portion obtains both a cumulative number of printed sheets Ptt1 that is a cumulative number of sheets of the recording medium on which an image is formed since the developer accommodating unit is mounted in the main body, and a developer remaining amount Rt that is an amount of developer remaining in the developer accommodating unit. The determining portion determines in the developer-saving mode whether a first inequality $Rt \leqq Tbase \times Sdef \times (Pmax - Pttl)$ is satisfied, where a default saving coefficient Sdef is a default value of the saving coefficient S, and a maximum number of printable sheets Pmax is a maximum number of printable sheets that is preset for the developer accommodating unit. The saving-coefficient setting portion sets the saving coefficient S to the default saving coefficient Sdef if the determining portion determines that the first inequality is satisfied, and sets the saving coefficient S to a value satisfying a second inequality $Sdef < S \leqq Rt/\{Tbase \times (Pmax - Pttl)\}$ if the determining portion determines that the first inequality is not satisfied.

According to another aspect, the invention also provides an image forming apparatus. The image forming apparatus includes a main body, a developer accommodating unit, an image forming unit, a mode setting portion, a parameter obtaining portion, a determining portion, and a saving-coefficient setting portion. The developer accommodating unit is configured to accommodate developer and is detachably mounted in the main body. The image forming unit forms an image on a surface of a recording medium with the developer. The mode setting portion sets a mode to either one of: a normal mode in which a developer amount set value T is set to a base developer amount Tbase, the developer amount set value T being an amount of developer consumed for forming an image on a single sheet of the recording medium, and a developer-saving mode in which the developer amount set value T is set to a value smaller than the bass developer amount Tbase based on a saving coefficient S, the saving coefficient S being greater than zero and smaller than one. The parameter obtaining portion obtains both a cumulative number of printed sheets Pttl that is a cumulative number of sheets of the recording medium on which an image is formed since the developer accommodating unit is mounted in the main body, and a developer remaining amount Rt that is an amount of developer remaining in the developer accommodating unit. The determining portion determines in the developer-saving mode whether the developer runs out before the cumulative number of printed sheets Pttl reaches a maximum number of printable sheets Pmax, the maximum number of printable sheets Pmax being a maximum number of printable sheets that is preset for the developer accommodating unit. The saving-coefficient setting portion sets the saving coefficient S to a default saving coefficient Sdef if the determining portion determines that the developer runs out before the cumulative number of printed sheets Pttl reaches the maximum number of printable sheets Pmax, the default saving coefficient Sdef being a default value of the saving coefficient S, and sets the saving coefficient S to a value larger than the default saving coefficient Sdef if the determining portion determines that the cumulative number of printed sheets Pttl reaches the maximum number of printable sheets Pmax in a state where the developer is left in the developer accommodating unit.

According to still another aspect, the invention also provides a computer readable product storing a set of program instructions executable on an image forming apparatus. The set of program instructions includes: setting a mode for printing to either one of: a normal mode in which a developer amount set value T is set to a base developer amount Tbase, the developer amount set value T being an amount of developer consumed for forming an image on a single sheet of a recording medium; and a developer-saving mode in which the developer amount set value T is set to a value smaller than the base developer amount Tbase based on a saving coefficient S, the saving coefficient S being greater than zero and smaller than one; obtaining both a cumulative number of printed sheets Pttl that is a cumulative number of sheets of the recording medium on which an image is formed since a developer accommodating unit is mounted in a main body of the image forming apparatus, and a developer remaining amount Rt that is an amount of developer remaining in the developer accommodating unit; determining in the developer-saving mode whether a first inequality $Rt \leqq Tbase \times Sdef \times (Pmax - Pttl)$ is satisfied, where a default saving coefficient Sdef is a default value of the saving coefficient S, and a maximum number of printable sheets Pmax is a maximum number of printable sheets that is preset for the developer accommodating unit; and setting the saving coefficient S to the default saving coefficient Sdef if the first inequality is satisfied, and setting the saving coefficient S to a value satisfying a second inequality $Sdef < S \leqq Rt/\{Tbase \times (Pmax - Pttl)\}$ if the first inequality is not satisfied.

BRIEF DESCRIPTION OF THE DRAWINGS

Embodiments in accordance with the invention will be described in detail with reference to the following figures wherein:

FIGS. 14A through 14C are explanatory diagrams showing a process for adjusting a toner amount in a toner-saving mode according to another modification, wherein FIG. 14A shows an example of image data on which a monochrome-conversion process and a toner-saving process have been performed (an example of binarized pattern), FIG. 14B shows an example of a mask pattern for thinning out dots for an amount of toner saving, and FIG. 14C shows an example of new image data which is generated by thinning out dots in the image data of FIG. 14A using the mask pattern of FIG. 14B.

DETAILED DESCRIPTION

An image forming apparatus according to some aspects of the invention will be described while referring to the accompanying drawings. In the following description, the expressions "front", "rear", "upper", "lower", "right", and "left" are used to define the various parts when the image forming apparatus is disposed in an orientation in which it is intended to be used.

Figure 1:
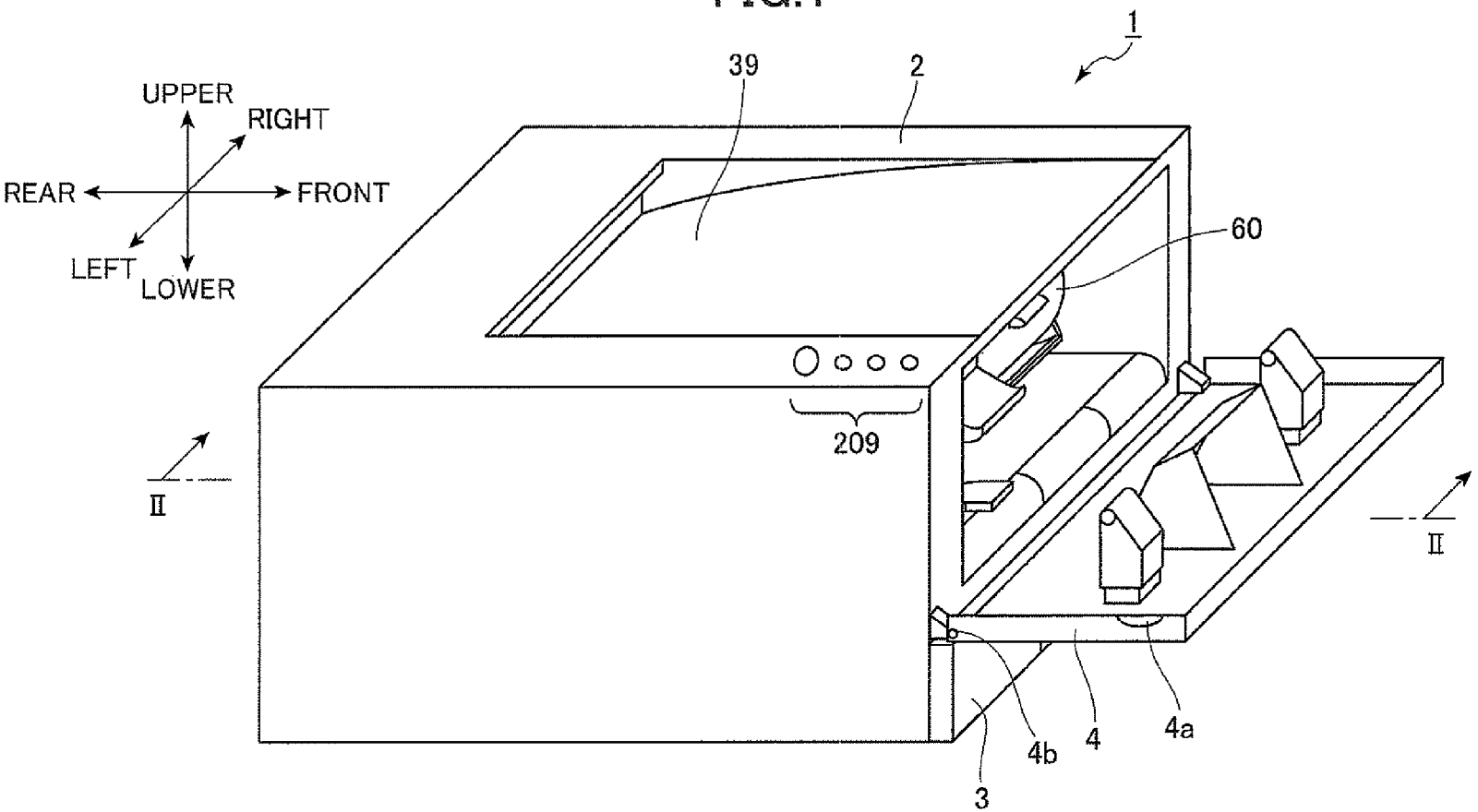
FIG. 1 is a perspective view showing a laser printer according to a first embodiment of the invention, wherein a lid is opened so that cartridges are mounted to the laser printer.

1. First Embodiment a) An image forming apparatus according to a first embodiment of the invention will be described while referring to FIGS. 1 through 8. The image forming apparatus of the first embodiment is applied to a laser printer 1. First, a description is given for the overall structure of the laser printer 1. FIG. 1 is a perspective view showing the appearance of the laser printer 1. As shown in FIG. 1, a sheet cassette 3 is mounted into a lower portion of a casing (main body) 2. The casing 2 includes various units of the laser printer 1. A lid 4 is provided on a front surface of the casing 2 (in other words, a near side from the user when the laser printer 1 is disposed).

The lid 4 is formed with finger holes 4*a* at upper right and left ends. As shown in FIG. 1, the lid 4 is opened toward the user by putting a finger in each of the finger holes and then pulling the lid 4. An operation section 209 is provided on the top surface of the casing 2 of the laser printer 1. The operation section 209 includes various kinds of keys operable by the user. The user can set the laser printer 1 to either a normal mode or a toner-saving mode for reducing toner consumption through the operation section 209.

Figure 2:
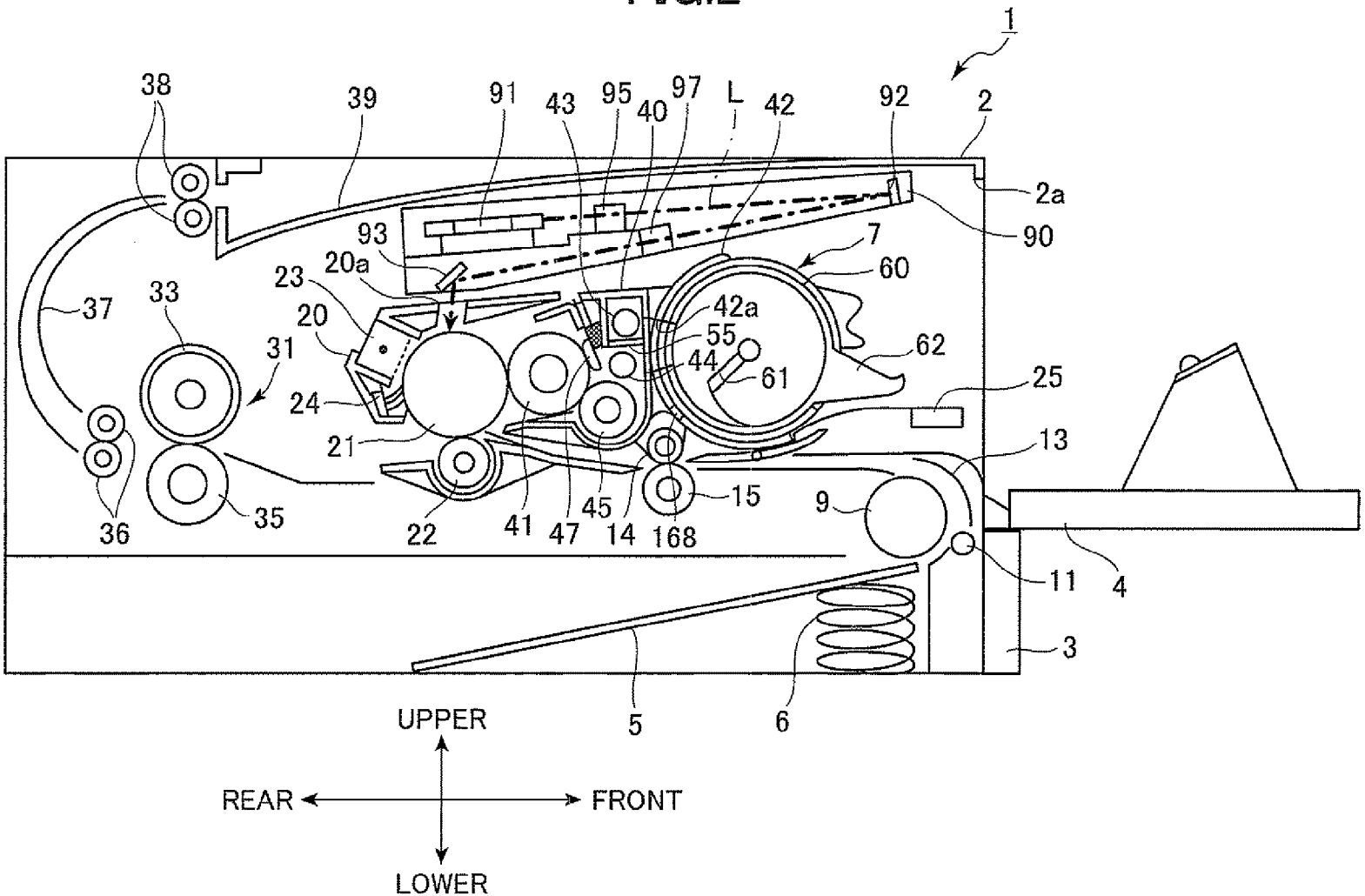
FIG. 2 is a vertical cross-sectional view taken along a line II-II in FIG. 1, for showing the internal structure of the laser printer of FIG. 1.

FIG. 2 is a cross-sectional view taken along a line II-II shown in FIG. 1, showing the inner structure of the laser printer 1 in a state where the lid 4 is opened. Although FIG. 2 is shown in a state where the lid 4 is opened, an electrophotographic image is formed normally in a state where the lid 4 is closed. In FIG. 2, the lid 4 is shown in an opened state for illustrating replacement operation of a toner cartridge 60 to be described later.

Inside the sheet cassette 3, a support plate 5 is urged upwardly by a spring 6. A sheet-separation roller 9 is provided above the support plate 5 and at the front part of the casing 2. The sheet-separation roller 9 separates one sheet from a stack of sheets (not shown) supported on the support plate 5, and then feeds the separated sheet toward an image forming section 7. Along a sheet conveying path leading from the sheet-separation roller 9 to the image forming section 7 are provided a conveying roller 11 for conveying the sheet in cooperation with the sheet-separation roller 9; a guide 13 for turning the sheet fed by the conveying roller 11 approximately at an angle of 180 degrees along a periphery of the sheet-separation roller 9; and a pair of registration rollers 14 and 15 for holding the leading end of the sheet by making a stop as required so as to correct obliqueness of the sheet if the sheet is conveyed obliquely. The conveying roller 11, the guide 13, and the registration rollers 14 and 15 are arranged in this order.

The image forming section 7 includes a photosensitive drum 21 provided in a photosensitive cartridge 20 (electrostatic latent image bearing member); and a transfer roller 22 provided to confront the photosensitive drum 21. The sheet passes between the photosensitive drum 21 and the transfer roller 22, 50 that a toner image is formed on the sheet as will be described later. The sheet on which an image is formed is conveyed to a fixing section 31. In the fixing section 31, a heat roller 33 and a pressure roller 35 hold the image-formed sheet therebetween so that the toner is heat-fixed. The sheet on which an image is fixed is further conveyed by a pair of conveying rollers 36 and 36.

The sheet fed by the conveying rollers 36 and 36 is guided by a guide 37 to an upper portion of the casing 2. The sheet is discharged by a pair of discharge rollers 38 and 38 onto a paper discharge tray 39 provided on the top face of the cover. Between the paper discharge tray 39 and the photosensitive cartridge 20, a scanner unit 90 is provided for exposing the photosensitive drum 21 to laser light L.

b) Next, the configuration of the image forming section 7 and the configuration of the scanner unit 90 are described further in detail. As shown in FIG. 2, the photosensitive cartridge 20 includes the photosensitive drum 21 having a photosensitive layer on the surface thereof, arranged for rotation. The photosensitive cartridge 20 further includes the transfer roller 22 and a scorotron charger 23 (electrically-charging means) for evenly charging the surface of the photosensitive drum 21. On the surface of the photosensitive drum 21 charged by the scorotron charger 23, the laser light L incident from the scanner unit 90 through an exposure opening 20*a*, forms an electrostatic latent image. Subsequently, a developing roller 41, which is provided in a developing cartridge 40, supplies toner onto the surface of the photosensitive drum 21 so as to develop the electrostatic latent image. The toner adhered onto the photosensitive drum 21 is thus transferred to the sheet which has passed between the photosensitive drum 21 and the transfer roller 22. The image is thus formed on the sheet by the above procedure. In addition, a positively biased paper-powder brush 24 is in contact with the surface of the photosensitive drum 21 after image formation, so as to remove the paper powder (negatively charged) adhered from the sheet onto the photosensitive drum 21.

As shown in FIG. 2, the developing roller 41 is rotatably supported by the developing cartridge 40. The developing roller 41 is in contact with the photosensitive drum 21 and is rotatingly driven by a mechanism to be described later. The developing cartridge 40 includes a support member 42 (cartridge mounting section) for detachably supporting the toner cartridge 60. The support member 42 has an opening 42*a* for supplying toner from the toner cartridge 60 therethrough. The opening 42*a* is positioned at the center in an axial direction (left-right direction) The developing cartridge 40 further includes an upper auger 43 and a lower auger 44 for circulating the toner supplied through the opening 42*a* toward both sides in the axial direction; a toner-supplying roller 45 for supplying the toner supplied by the upper auger 43 and the lower auger 44 to the developing roller 41; and a developing blade 47 for forming a thin layer of toner by tribo-charging the toner adhered to the surface of the developing roller 41 by friction. Inside the toner cartridge 60, an agitator 61 is rotatably provided for agitating the toner accommodated therein and then supplying the toner toward the developing cartridge 40.

Next, the configuration of the scanner unit 90 is described. The scanner unit 90 includes a polygon mirror 91 for scanningly deflecting the laser light L emitted from a laser unit (not shown) for scanning; and mirrors 92 and 93 for reflecting the laser light L deflected by the polygon mirror 91 to the photosensitive drum 21. An fθ lens 95 is provided on an optical path of laser light L from the polygon mirror 91 to the mirror 92. A cylindrical lens 97 is provided on an optical path of laser light L from the mirror 92 to the mirror 93.

According to the configuration described above, when the lid 4 is closed, an electrostatic latent image can be formed on the surface of the photosensitive drum 21 by emitting laser light L, while rotating the polygon mirror 91 and the photosensitive drum 21 at appropriate timings. The electrostatic latent image is developed with toner through the developing roller 41, and the toner is then transferred onto a sheet, thereby forming an electrophotographic image.

As has been described above, the laser printer 1 can be set to either the normal mode or the toner-saving mode through the operation section 209. An amount of toner to be consumed for printing is changed depending on which mode is set, and on what amount of toner is left in the toner cartridge 60 in the case when the toner-saving mode is set. Detailed description is provided later.

Referring to FIG. 2, when a handle 25 of the photosensitive cartridge 20 is pulled toward the user in a state where the lid 4 is opened, the photosensitive cartridge 20 can be removed from the casing 2 (main body) of the laser printer 1 through a replacement opening 2*a*. The photosensitive cartridge 20 is removed together with the developing cartridge 40 and the toner cartridge 60 as a unit Note that the replacement opening 2*a* is formed in the casing 2 and is covered with the lid 4. Further, as a handle 62 of the toner cartridge 60 is turned upward, the toner cartridge 60 is separated from the developing cartridge 40. Further, when the handle 62 is pulled toward the user, the toner cartridge 60 alone is removed from the casing 2 of the laser printer 1 through the replacement opening 2*a*. In a modification, the toner cartridge 60 and the photosensitive cartridge 20 may be provided as an integral unit (not shown).

Figure 3A:
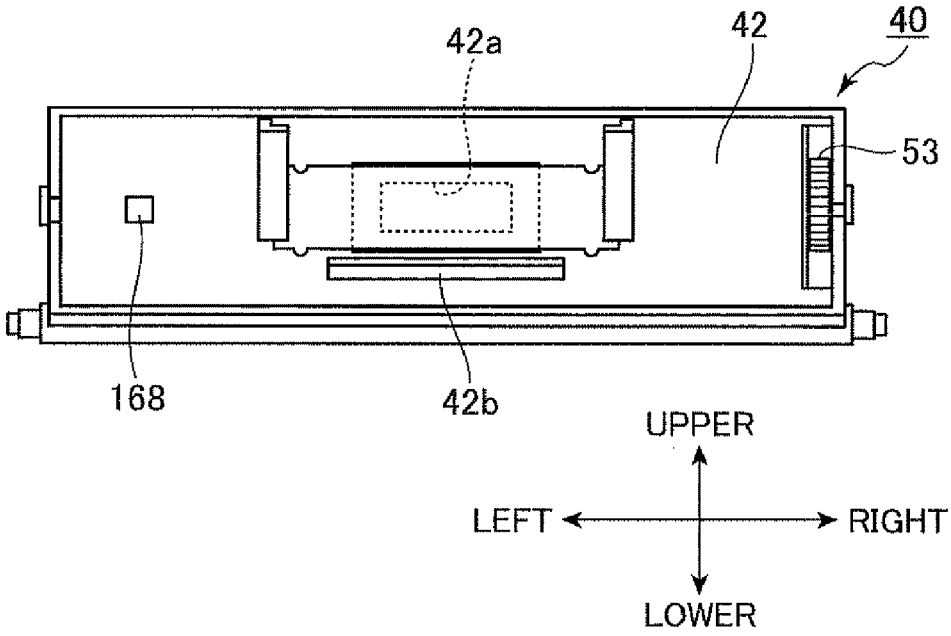
FIG. 3A is a front view of a developing cartridge for particularly showing gear structures between the developing cartridge and a toner cartridge.
Figure 3B:
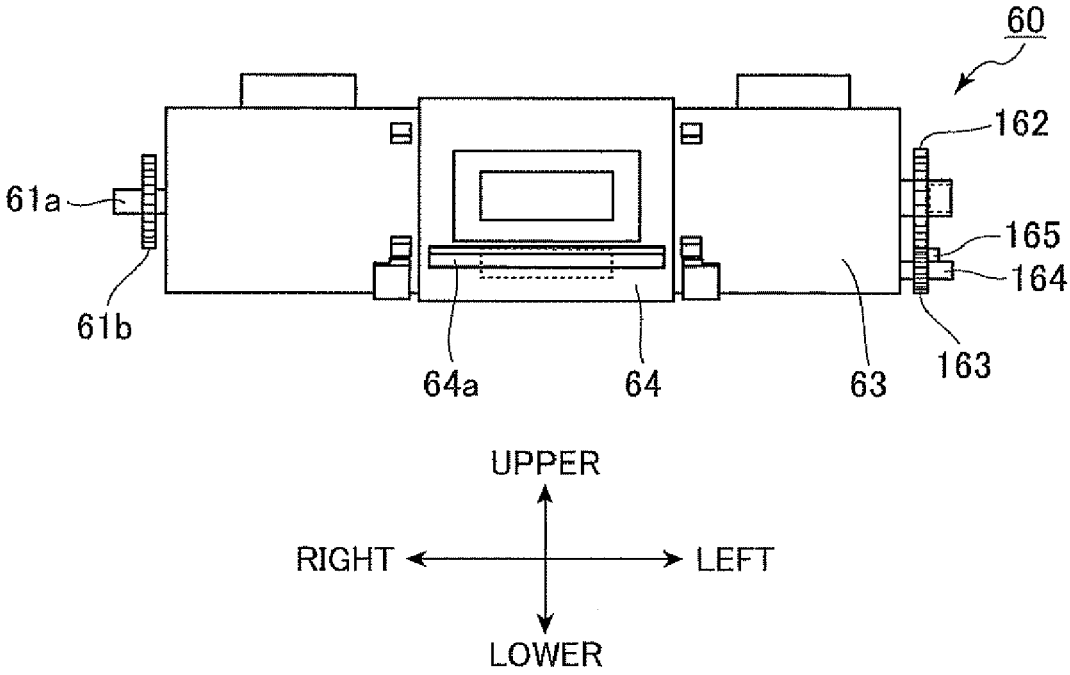
FIG. 3B is a rear view of the toner cartridge for particularly showing the gear structures between the developing cartridge and the toner cartridge.

The configuration of the toner cartridge 60 is described with reference to FIGS. 3A and 3B. The toner cartridge 60 can be engaged with or disengaged from the developing cartridge 40. FIG. 3A shows the support member 42 of the developing cartridge 40 as viewed from the toner cartridge 60 (as viewed from the front side). FIG. 3B shows the toner cartridge 60 as viewed from the support member 42 (as viewed from the rear side).

Referring to FIG. 3B, the toner cartridge 60 includes an elongated cylindrical inner tube member 63 for accommodating toner therein, and an outer tube member 64 to be fitted around the inner tube member 63 at the middle in the left-right direction. A protrusion 64*a* protruding toward the support member 42 is fitted into an elongated groove 42*b* formed in the inner surface of the support member 42, so that the outer tube member 64 is unrotatably mounted to the support member 42. The handle 62 (FIG. 2) is integrally formed with the inner tube member 63. The inner tube member 63 can be rotated inside the outer tube member 64 in accordance with the operation of the handle 62.

A gear 61*b* is provided at the right end of the inner tube member 63 for rotating integrally with a shaft 61*a* of the agitator 61. As shown in FIG. 3A, at a position confronting the gear 61*b* within the support member 42, a gear 53 is exposed so as to engage with the gear 61*b* when the toner cartridge 60 is mounted on the support member 42. The gear 53 engages with each of the gear 61*b*, a gear (not shown) which rotates together with the upper auger 43 of the toner cartridge 60, and another gear (not shown) which rotates together with the lower auger 44 of the toner cartridge 60.

Therefore, as driving force is transferred to the shaft 61*a* from a driving shaft (not shown) provided inside the laser printer 1, the driving force rotates the agitator 61. The driving force is also transferred to the gear 61*b*, the gear (not shown) rotating with the upper auger 43, and the gear (not shown) rotating with the lower auger 44 in this order, thereby rotating the upper auger 43 and the lower auger 44. This operation causes toner to circulate within the developing cartridge 40. The operation also causes toner to circulate between the developing cartridge 40 and the toner cartridge 60. Therefore, the operation prevents degraded toner from adhering to a certain portion in the developing cartridge 40 and toner cartridge 60, for maintaining fluidity of toner until the amount of remaining toner becomes zero. The operation also prevents toner from becoming unusable before replacing the toner cartridge.

Figure 4A:
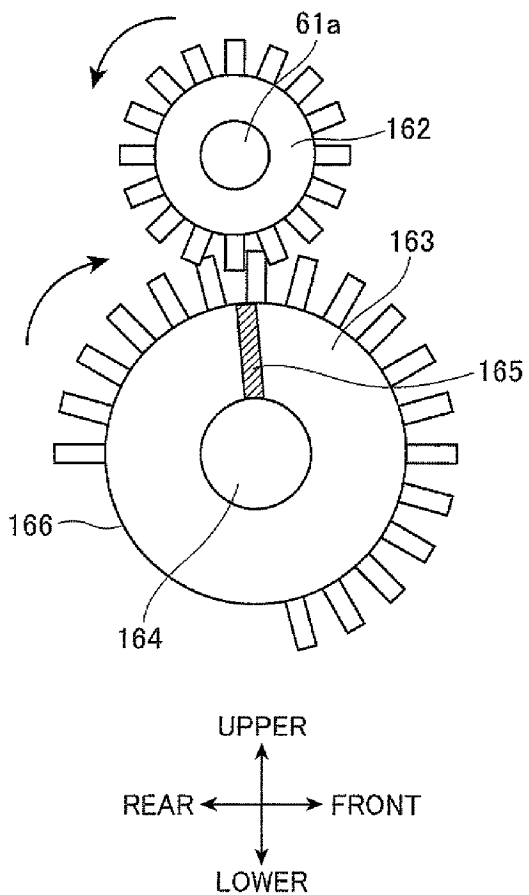
FIG. 4A is a left side view for showing the structure and operations of a check gear provided to a toner cartridge and for showing a state where the toner cartridge has never been mounted on the laser printer.
Figure 4B:
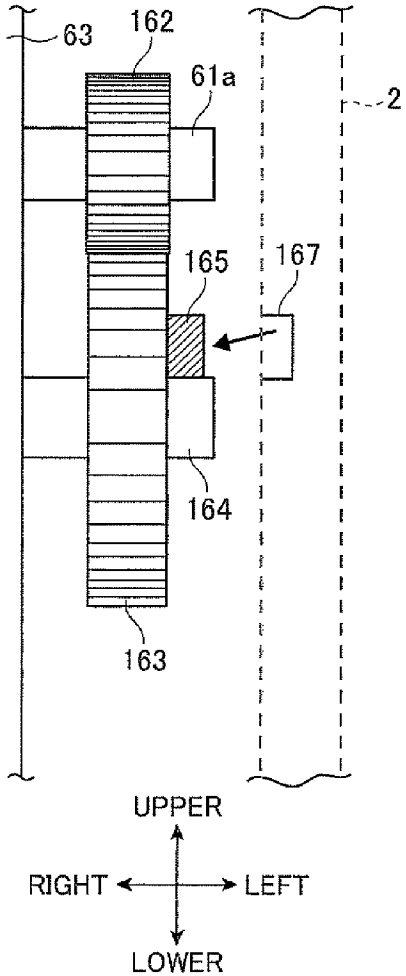
FIG. 4B is a rear view for showing the structure and operations of the check gear shown in FIG. 4A.

FIG. 4A shows a new toner cartridge 60 which has never been mounted to the laser printer 1. In FIG. 4A, a first new-toner-cartridge check gear 162 and a second new-toner-cartridge check gear 163 are viewed from the left. FIG. 4B shows a case in which the first new-toner-cartridge check gear 162 and the second new-toner-cartridge check gear 163 shown in FIG. 4A are viewed from the rear. A single protruding plate 165 is provided on the left side of the second new-toner-cartridge check gear 163, extending from the inner periphery to the outer periphery of the second new-toner-cartridge check gear 163. When a new toner cartridge 60 is mounted, the protruding plate 165 is positioned at its approximately uppermost position as shown in FIG. 4A. The second new-toner-cartridge check gear 163 has a toothless section 166 at which no teeth are provided, occupying approximately one-fourths of the circumference. When a new toner cartridge 60 is mounted, the toothless section 166 is positioned on the rear-lower side of the second new-toner-cartridge check gear 163 as shown in FIG. 4A.

Figure 4C:
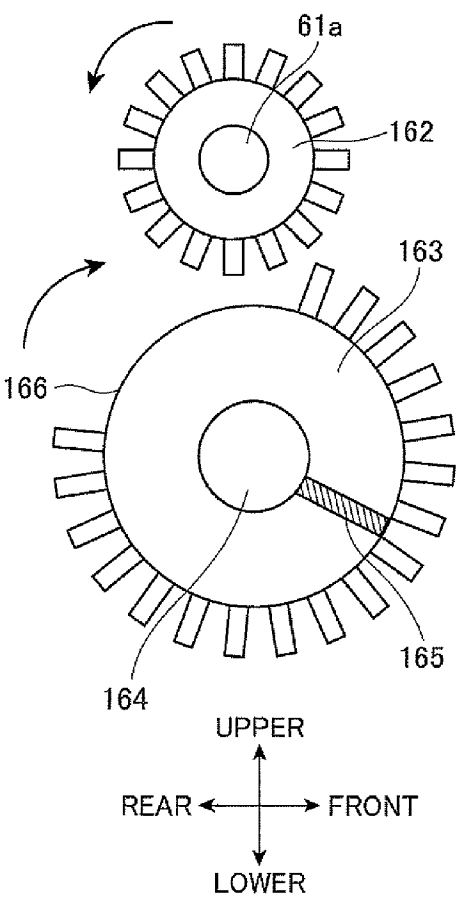
FIG. 4C is a left side view for showing the structure and operations of the check gear and for showing a state where the toner cartridge is mounted on the laser printer and first and second new-toner-cartridge check gears have rotated by predetermined amounts.

As the new toner cartridge 60 is mounted to the laser printer 1 and the shaft 61*a* starts rotating, the first new-toner-cartridge check gear 162 and the second new-toner-cartridge check gear 163 also start rotating. As the toothless section 166 of the second new-toner-cartridge check gear 163 arrives on the side of the first new-toner-cartridge check gear 162 as shown in FIG. 4C, the driving force stop its transfer, thereby stopping the rotation of the second new-toner-cartridge check gear 163 at that point. From this time on, the second new-toner-cartridge check gear 163 stays in a stopped state even though the first new-toner-cartridge check gear 162 further rotates. During this operations the protruding plate 165 makes an approximately 90-degree turn from the initial approximately uppermost position (the position shown in FIG. 4A) in a clockwise direction. The protruding plate 165 then stops rotating at the position shown in FIG. 4C. In contrast, if a toner cartridge 60 has been used at least once, the second new-toner-cartridge check gear 163 is oriented as shown in FIG. 4C. Therefore, if a used toner cartridge 60 is mounted to the laser printer 1, the protruding plate 165 never turns in the manner described above. In other words, the protruding plate 165 turns only once when a new toner cartridge 60 is mounted and the laser printer 1 is powered on for the first time.

As shown in FIG. 4B, inside the casing 2 of the laser printer 1 at a position confronting the second new-toner-cartridge check gear 163, a new toner check switch 167 is provided so as to detect the protruding plate 165. When the protruding plate 165 turns in the aforementioned manner with the mounted new toner cartridge 60, the new toner check switch 167 is turned ON as the protruding plate 165 approaches the new toner check switch 167. After that, as the protruding plate 165 moves away from the protruding plate 165, the new toner check switch 167 is turned OFF. Thus, switching from ON to OFF of the new toner check switch 167 corresponds to turning movement of the protruding plate 165 made when the new toner cartridge 60 is mounted.

Figure 5:
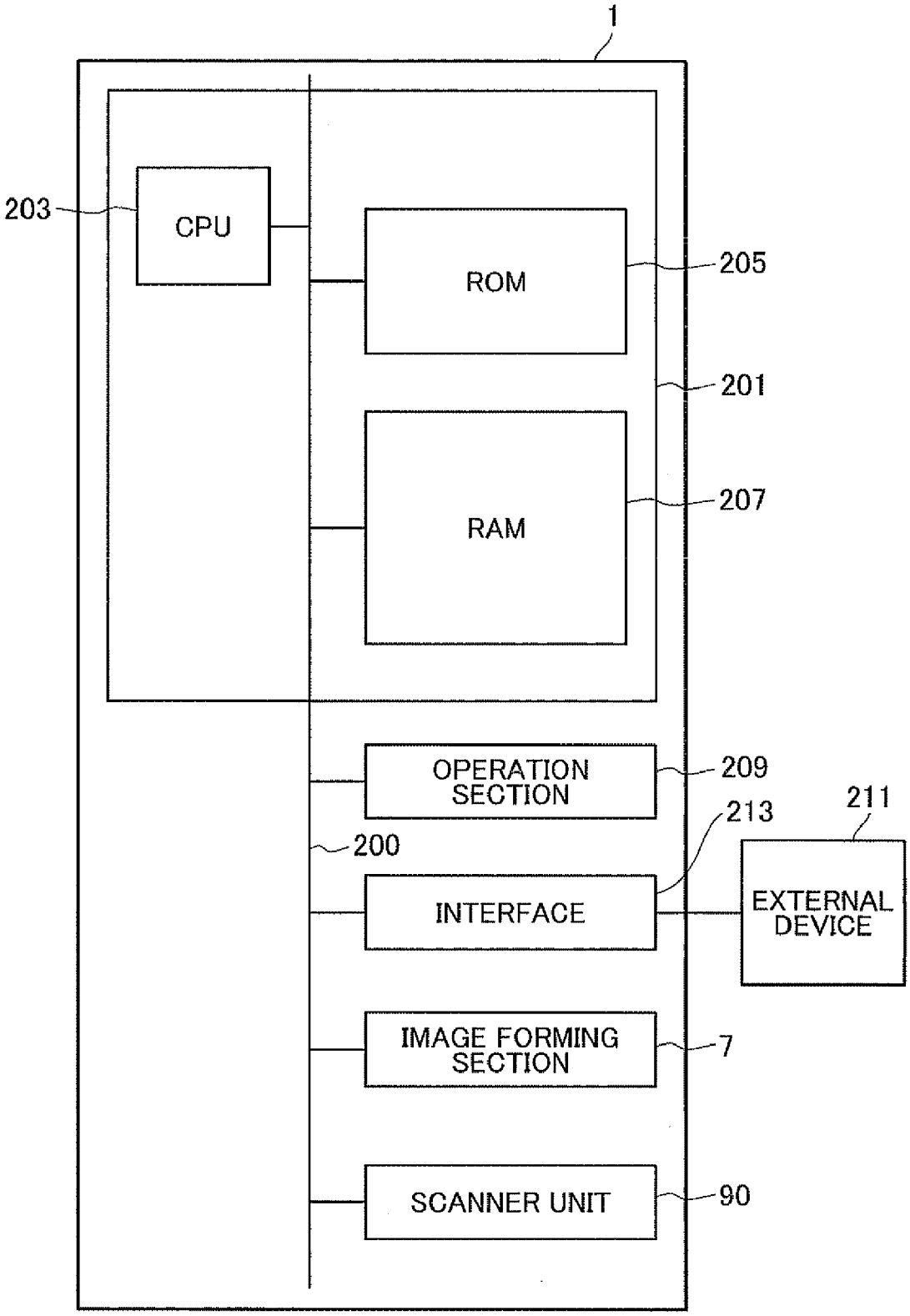
FIG. 5 is a block diagram showing the electrical configuration of the laser printer.

Referring to FIGS. 2 and 3A, the support member 42 includes a toner cartridge mounting detection switch 168. The toner cartridge mounting detection switch 168 is turned ON by pressure when the toner cartridge 60 is mounted When the toner cartridge 60 is not mounted, the toner cartridge mounting detection switch 168 is OFF since the pressure is released. Therefore, the switching from OFF to ON performed by the toner cartridge mounting detection switch 168 corresponds to the mounting operation of the toner cartridge 60.

d) Next, the electrical configuration of the laser printer 1 is described with reference to a block diagram shown in FIG. 5.

The laser printer 1 includes a control unit 201 for controlling each of the components including the image forming section 7 and the scanner unit 90. The components are connected via a bus 200. The control unit 201 includes a CPU 203, a ROM 205 for storing various programs to be executed by the CPU 203 as well as various kinds of data required for program execution, and a RAM 207 used as a working memory for program execution. The RAM 207 is a non-volatile memory that is capable of storing data even after a power to the laser printer 1 is turned off.

The data stored in the ROM 205 includes a toner capacity Tmax which indicates a toner capacity of a toner cartridge 60 (an amount of toner accommodated in a new toner cartridge 60); a maximum number of printable sheets Pmax which indicates the maximum number of printable sheets that is preset for the toner cartridge 60 (a value predetermined in consideration of mechanical durability of the toner cartridge 60); a base toner amount Tbase which indicates a set amount of toner to be consumed per one sheet in the normal mode; and a default saving coefficient Sdef which indicates a default value of a saving coefficient S to be used in the toner-saving mode (for example, 0.7).

The data stored and updated in the RAM 207 includes a cumulative use amount Tuse which indicates a cumulative amount of toner consumed after a new toner cartridge 60 is mounted for a replacement. The cumulative use amount Tuse is obtained by calculating T1+T2+ . . . +Tn, where the number of sheets which have been printed since the new toner cartridge 60 is mounted is n, and toner amounts (toner amount set value T) consumed for the respective sheets are set to T1, T2, . . . Tn. The control unit 201 updates the cumulative use amount Tuse based on the above calculation method, every time printing is performed on one sheet since a new toner cartridge 60 is mounted. Note that the control unit 201 obtains the toner amount set value T which indicates an amount of toner to be consumed per one sheet, as follows. Specifically, if printing is performed on a given sheet in the normal mode, the toner amount set value T is set to the base toner amount Tbase which is predetermined. In the toner-saving mode, the toner amount set value T is set to a value set (calculated) in a toner amount setting process to be described later. If the toner cartridge mounting detection switch 168 switches from OFF to ON followed by switching operation from ON to OFF of the new toner check switch 167, the control unit 201 determines that a new toner cartridge 60 has been mounted as a replacement, and then resets the cumulative use amount Tuse to zero.

The data stored and updated in the RAM 207 further includes a cumulative number of printed sheets Pttl which indicates a cumulative number of sheets printed since the new toner cartridge 60 is mounded. The control unit 201 updates the cumulative number of printed sheets Ptt1 every time printing is performed on one sheet. When the control unit 201 determines that the new toner cartridge 60 has been mounted (when the toner cartridge mounting detection switch 168 switches from OFF to ON followed by switching operation from ON to OFF of the new toner check switch 167), the control unit 201 resets the cumulative number of printed sheets Pttl to zero.

The laser printer 1 further includes the operation section 209 (see FIG. 1) The user can set the laser printer 1 to either the normal mode or the toner-saving mode as a printing mode, through the operation section 209.

Figure 6:
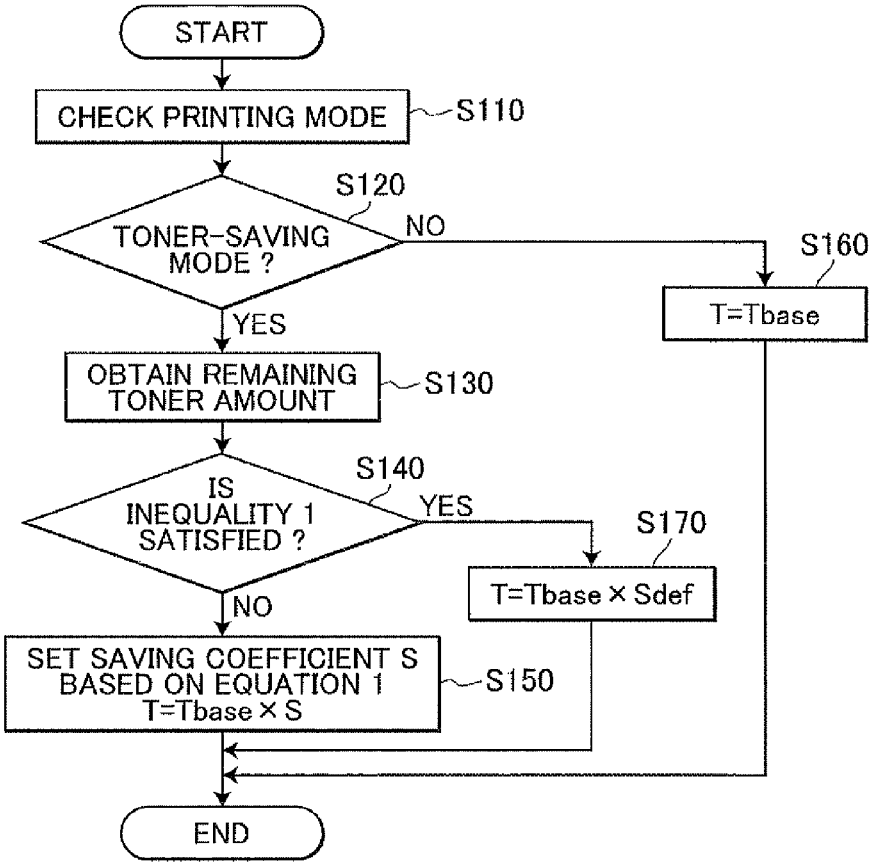
FIG. 6 is a flowchart showing a toner amount setting process according to the first embodiment.

The laser printer 1 also includes an interface 213 capable of communicating with an external device 211 (personal computer or the like). The control unit 201 performs known monochrome-conversion and halftone processes in series on image data inputted from the external device 211. The control unit 201 then prints out the processed image data.

e) Referring next to the flowchart of FIG. 6, a description is given for the toner amount setting process to be performed by the control unit 201 for forming an image on a sheet. Steps are hereinafter referred to as "S". In S110 the control unit 201 determines to which mode the laser printer 1 is set for printing, either the normal mode or the toner-saving mode.

In S120, if the toner-saving mode is set for printing, the process proceeds to S130. If the normal mode is set, the process proceeds to S160.

In S130 the control unit 201 obtains a toner remaining amount Rt which indicates an amount of toner left in the toner cartridge 60 at that point in time. The toner remaining amount Rt is obtained by subtracting the cumulative use amount Tuse stored in the RAM 207 from the toner capacity Tmax stored in the ROM 205.

In S140 the control unit 201 determines whether Inequality 1 is satisfied.

$$Rt \leqq T\text{base} \times Sdef \times (P\text{max} - Pttl) \quad \text{(Inequality 1)}$$

If Inequality 1 is not satisfied (S140: No), the process proceeds to S150. If Inequality 1 is satisfied (S140: Yes), the process proceeds to S170.

In S150, the control unit 201 obtains the saving coefficient S based on Equation 1. Then, the control unit 201 sets the toner amount set value T to a value obtained by multiplying the base toner amount Tbase by the saving coefficient S.

$$S = Rt/\{T\text{base} \times (P\text{max} - Pttl)\} \quad \text{(Equation 1)}$$

The saving coefficient S is basically less than 1 or equal to 1. However, if the saving coefficient S exceeds 1 for some reason, the saving coefficient S is set to 1, such that printing is performed with toner density that is the same as in the normal mode even if the toner-saving mode is set.

If the normal mode is set in S120 (S120: No), the process proceeds to S160. In S160, the control unit 201 sets the toner amount set value T to the base toner amount Tbase.

Figure 7:
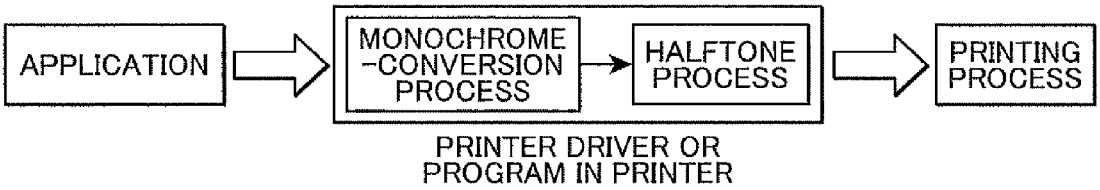
FIG. 7 is an explanatory diagram showing a method for processing image data according to the first embodiment.
Figure 8:
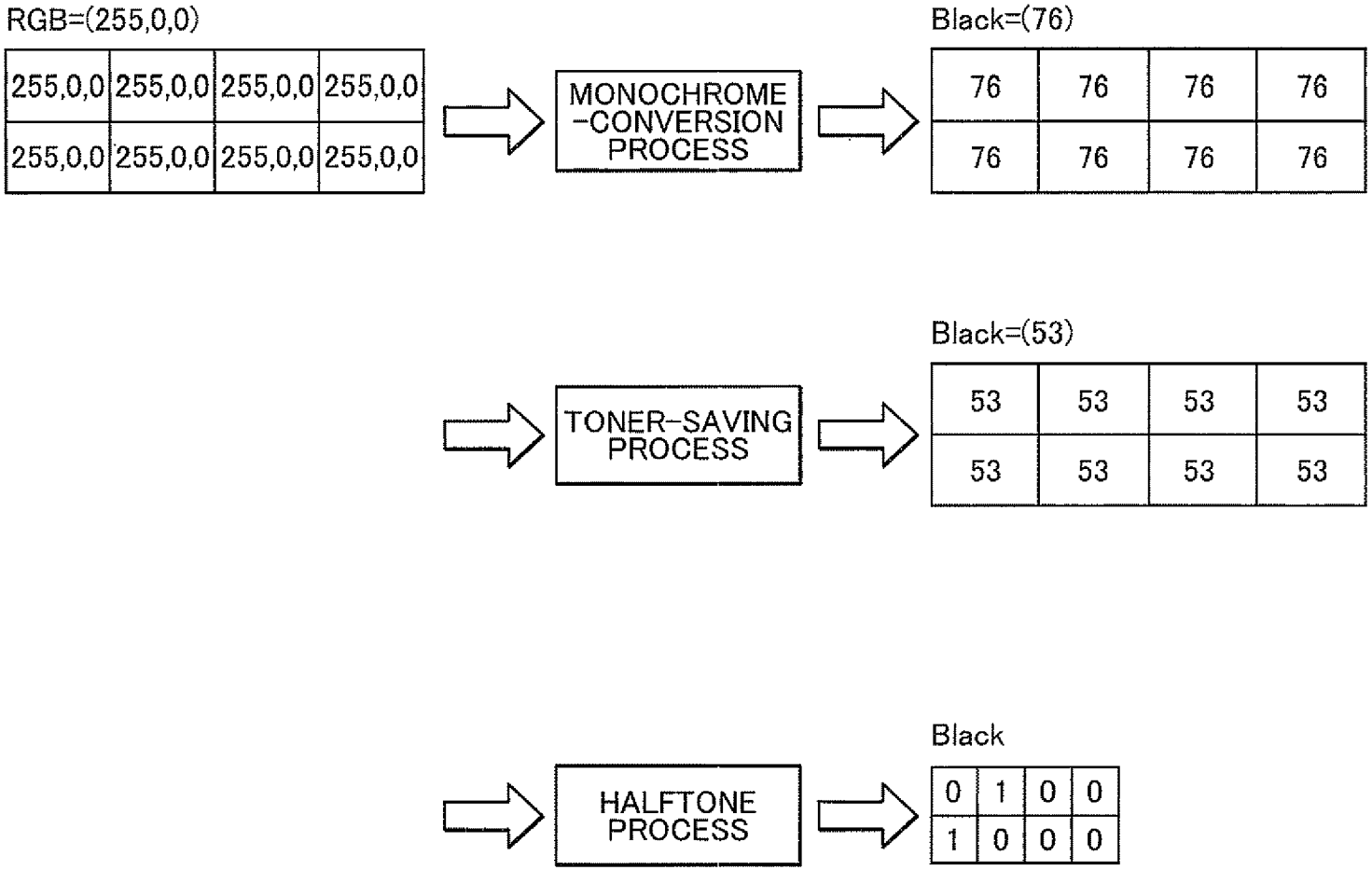
FIG. 8 is an explanatory diagram showing a method for adjusting a toner amount in a toner-saving mode according to the first embodiment.

If Inequality 1 is satisfied in S140 (S140: Yes), the process proceeds to S170. In S170, the control unit 201 sets the toner amount set value T to a value obtained by multiplying the base toner amount Tbase by the default saving coefficient Sdef.

f) Referring next to FIGS. 7 and 8, a description is given as to how the control unit 201 adjusts the toner amount according to the value set in the toner amount setting process of FIG. 6. As shown in FIG. 7, the control unit 201 of the laser printer 1 receives image data from an application of the external device 211 (see FIG. 5). Then, after performing the known monochrome-conversion and halftone processes in series on the image data, the laser printer 1 performs a printing process based on the image data.

If the toner-saving mode is selected, a toner-saving process is further performed between the monochrome-conversion process and the halftone process, as shown in FIG. 8. The toner amount is then adjusted according to the value set in the toner amount setting process. The matrix of cells shown in FIG. 8 represents image data, where each of the cells represents one pixel. For example, if the saving coefficient S is set to 0.7, a value of 53 is obtained by multiplying a black value 76 of each of the monochrome-conversion processed pixels by a value of 0.7 in the toner-saving process. Next, the value 53 is used for the halftone process. In other words, an amount of toner to be consumed is adjusted by changing values that are inputted to the halftone process according to the saving coefficient S, thereby changing the results of whether each dot is to be printed (whether each value is binarized to one or zero). On the other hand, if the normal mode is selected, the toner-saving process is not performed. The halftone process is performed immediately after the monochrome-conversion process.

g) Next, the effects obtained by the laser printer 1 of the embodiment are described. As indicated by Inequality 1, the laser printer 1 compares the toner remaining amount Rt with an amount of toner to be consumed assuming that printing is continued in the toner-saving mode until the cumulative number of printed sheets Pttl reaches the maximum number of printable sheets Pmax (Tbase×Sdef×(Pmax−Pttl)). If the toner remaining amount Rt is smaller, the default saving coefficient Sdef is set as the saving coefficient S used in the toner-saving mode. If the toner remaining amount Rt is larger, the value determined based on Equation 1 is set as the saving coefficient S used in the toner-saving mode.

In other words, in this embodiment, if the toner remaining amount Rt is small and it is expected that toner runs out before the cumulative number of printed sheets Pttl reaches the maximum number of printable sheets Pmax (i.e., if Inequality 1 is satisfied), the toner amount set value T (a toner amount to be consumed in the toner-saving mode) is set to the default value in the toner-saving mode. In contrast, if the toner remaining amount Rt is large and it is expected that the cumulative number of printed sheets Pttl reaches the maximum number of printable sheets Pmax in the toner-saving mode in a state where toner is left in the toner cartridge (i.e., Inequality 1 is not satisfied), the toner amount set value T is set to a value larger than the default value so that the toner remaining amount theoretically becomes zero when the cumulative number of printed sheets Pttl reaches the maximum number of printable sheets Pmax (when the toner cartridge 60 needs to be replaced). This reduces the amount of toner left in the toner cartridge 60 to be replaced, thereby preventing toner from being wasted.

2. Second Embodiment

Figure 9:
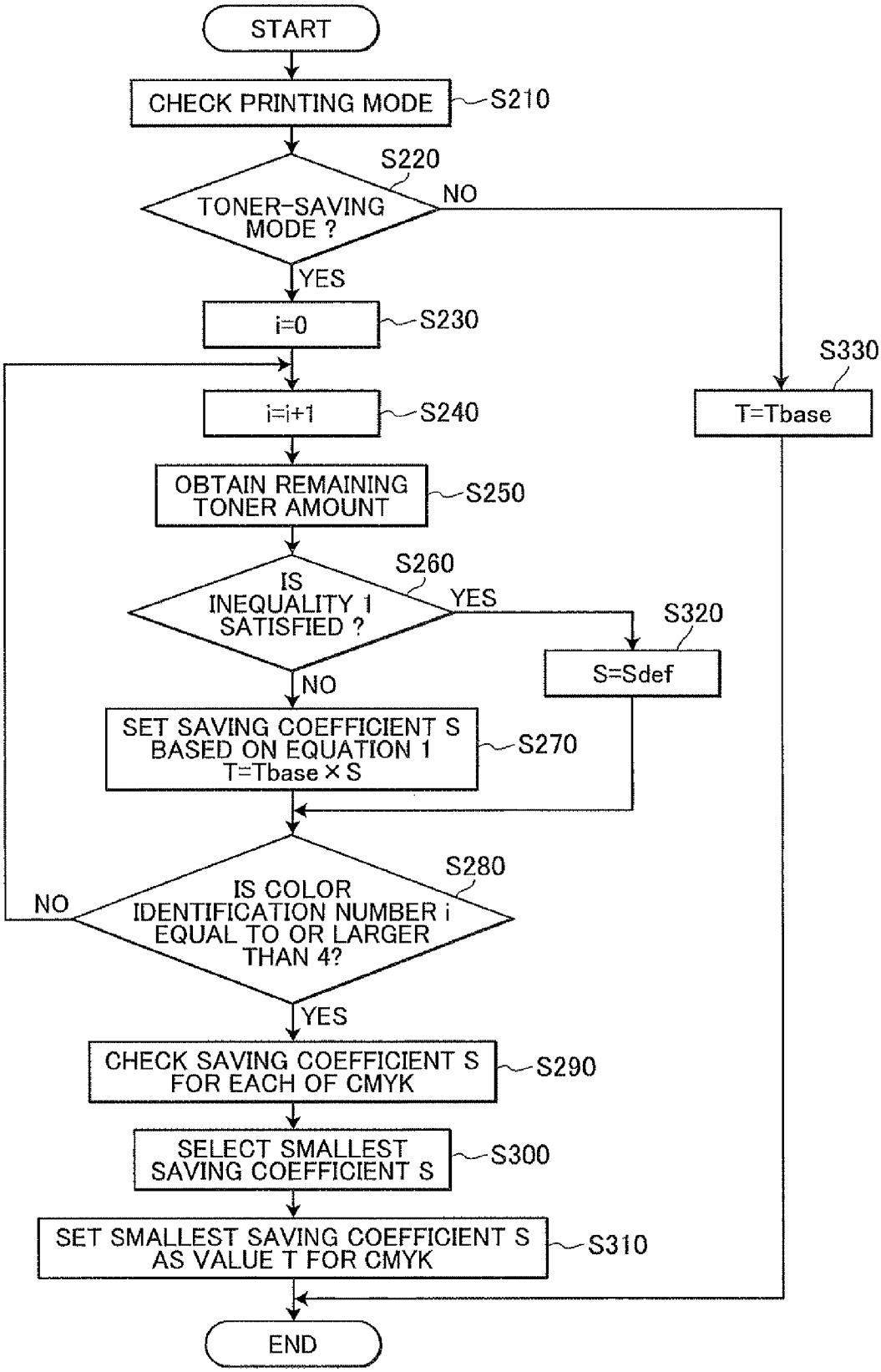
FIG. 9 is a flowchart showing a toner amount setting process according to a second embodiment of the invention.

An image forming apparatus according to a second embodiment of the invention will be described while referring to FIGS. 9 through 11, wherein like parts and components are designated by the same reference numerals to avoid duplicating description.

The configuration of the laser printer 1 according to the second embodiment is basically the same as in the first embodiment, except that the laser printer 1 according to the second embodiment can perform color printing. Specifically, the toner cartridge 60 contains four colors CMYK of toner. The image forming section 7 uses the four colors of toner so as to form a color image on a sheet. Note that the method for forming an image with the respective colors of toner by the image forming section 7 is basically the same as in the first embodiment.

In the second embodiment, the toner amount set value T (an amount of toner to be consumed per one sheet) needs to be set for each of the four colors of toner. Referring to the flowchart of FIG. 9, a description is given for a toner amount setting process according to the second embodiment to be performed by the control unit 201.

In S210 the control unit 201 determines which mode is set for printing, either the normal mode or the toner-saving mode. In S220, if the toner-saving mode is set for printing (S220: Yes), the process proceeds to S230. If the normal mode is set (S220: No), the process proceeds to S330.

In S230, the control unit 201 sets a color Identification number i of toner to 0. Regarding the color identification number i, a value of 1 corresponds to the color C, 2 to M, 3 to Y, and 4 to K. In S240, the color identification number i is incremented by 1.

In S250 the control unit 201 obtains the toner remaining amount Rt at that point in time, for the toner having the color corresponding to the current color identification number i. Specifically, the control unit 201 obtains the toner remaining amount Rt by subtracting the cumulative use amount Tuse stored in the RAM 207 from the toner capacity Tmax stored in the ROM 205.

In S260 the control unit 201 determines whether Inequality 1 is satisfied for the toner having the color corresponding to the color identification number i. If Inequality 1 is not satisfied (S260: No), the process proceeds to S270.

$$Rt \leqq T\text{base} \times Sdef \times (P\text{max} - Pttl) \quad \text{(Inequality 1)}$$

In S270 the control unit 201 obtains the value of the saving coefficient S based on Equation 1, for the toner having the color corresponding to the color identification number i.

$$S = Rt / \{T\text{base} \times (P\text{max} - Pttl)\} \quad \text{(Equation 1)}$$

If in S260 the control unit 201 determines that Inequality 1 is satisfied (S260: Yes), the process proceeds to S320. The control unit 201 sets the saving coefficient S to the default saving coefficient Sdef for the toner having the color corresponding to the color identification number i.

In S280 the control unit 201 determines whether the color identification number i has reached 4 (whether all the colors CMYK of toner have gone through S240 through S270 and S320. If so (S280: Yes) the process proceeds to S290. If not (S280: No), the process returns to S240.

In S290 the control unit 201 checks values of the saving coefficient S set for the respective CMYK colors in S270 or S320. In S300 the control unit 201 selects the smallest one from the values of the saving coefficient S for CMYK colors checked in S290.

In S310 the control unit 201 uses the saving coefficient S selected in S300 as a common saving coefficient S for all the colors CMYK. Using the common saving coefficient S, the control unit 201 sets the toner amount set value T (an amount of toner to be consumed per one sheet) to a value obtained by multiplying the base toner amount Tbase by the common saving coefficient S for each of the CMYK colors.

If in S220 the control unit 201 determines the normal mode is set for printing, the process proceeds to S330. In S330 the control unit 201 sets the toner amount set value T to the base toner amount Tbase for each of the CMYK colors. Note that the values of the base toner amount Tbase may differ depending on the color.

Figure 10:
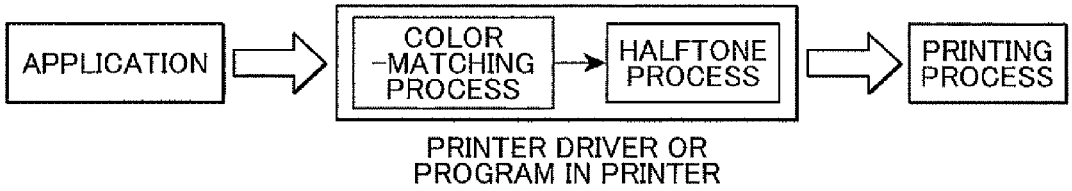
FIG. 10 is an explanatory diagram showing a method for processing image data according to the second embodiment.
Figure 11:
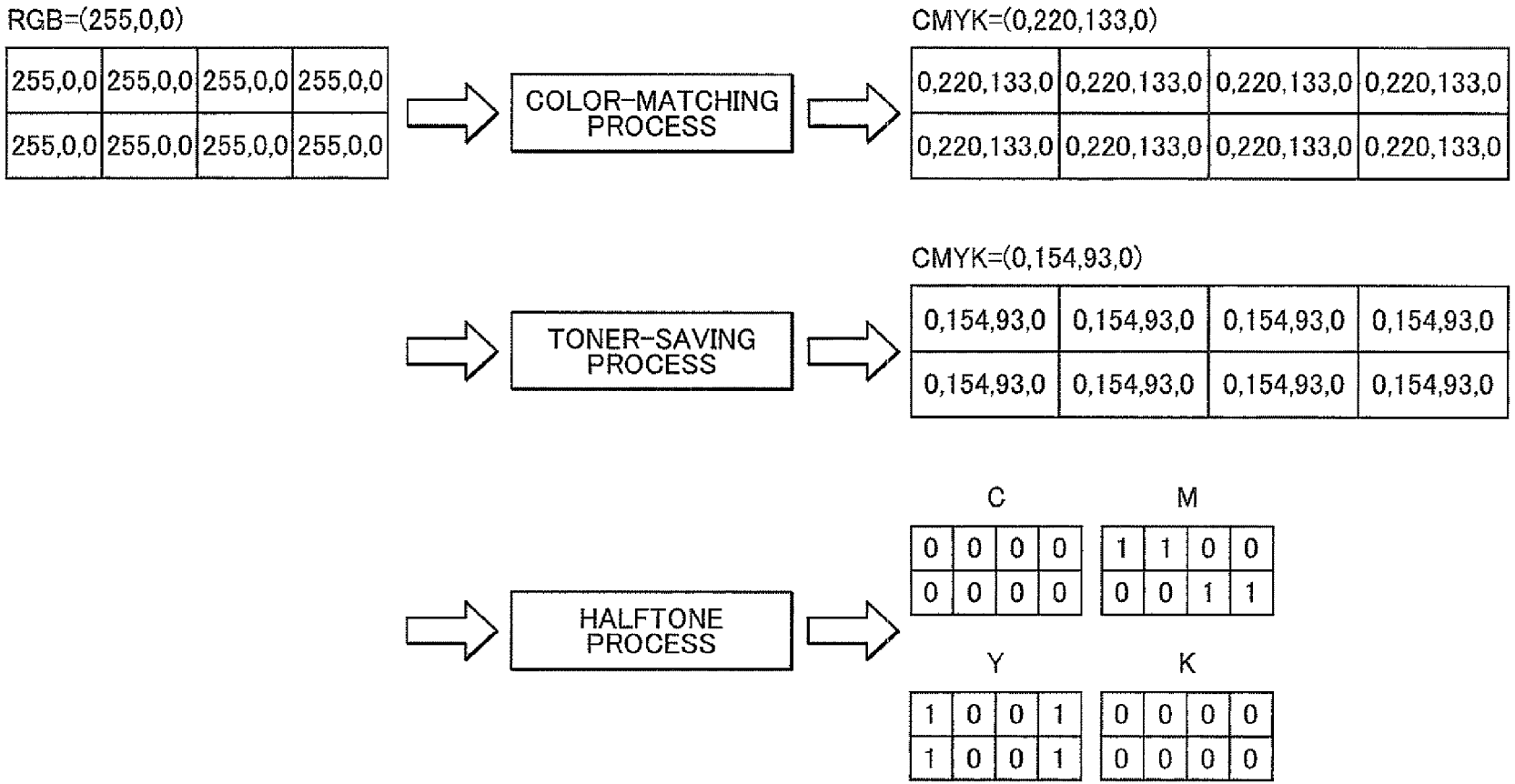
FIG. 11 is an explanatory diagram showing a method for adjusting a toner amount in a toner-saving mode according to the second embodiment.

Referring next to FIGS. 10 and 11, a description is given as to how the control unit 201 adjusts a toner amount according to the value set in the toner amount setting process. As shown in FIG. 10, the control unit 201 receives color image data from an application of the external device 211 (see FIG. 5). After performing known color-matching and halftone processes in series, the control unit 201 performs a printing process based on processed color image data.

As shown in FIG. 11, if the toner-saving mode is selected, a toner-saving process is also performed between the color-matching process and the halftone process. The toner amount is then adjusted according to the value set in the toner amount setting process described above. The matrix of cells shown in FIG. 11 represents image data, where each of the cells represents one pixel. For example, if the saving coefficient S is set to 0.7, each of the CMYK values of each color-matching processed pixel is multiplied by 0.7 in the toner-saving process. Next, the value obtained by multiplying 0.7 is used for the halftone process. In other words, an amount of toner to be consumed is adjusted by changing values that are inputted to the halftone process according to the saving coefficient S, thereby changing the results of whether each dot is to be printed (whether each value is binarized to one or zero). On the other hand, if the normal mode is selected, the toner-saving process is not performed. The halftone process is performed immediately after the color-matching process.

In this embodiment, since the saving coefficient S common to all the CMYK colors is used, a balance among the colors are maintained even when printing is performed in the toner-saving mode. Further, since the smallest value of the saving coefficient S is used, it is unlikely that the toner of a specific color runs out sooner than the other colors.

3. Third Embodiment

An image forming apparatus according to a third embodiment of the invention will be described while referring to FIG. 12, wherein like parts and components are designated by the same reference numerals to avoid duplicating description.

The configuration of the laser printer 1 according to the third embodiment is basically the same as in the second embodiment, except for the method for setting the toner amount set value T which is an amount of toner to be consumed per one sheet.

Figure 12:
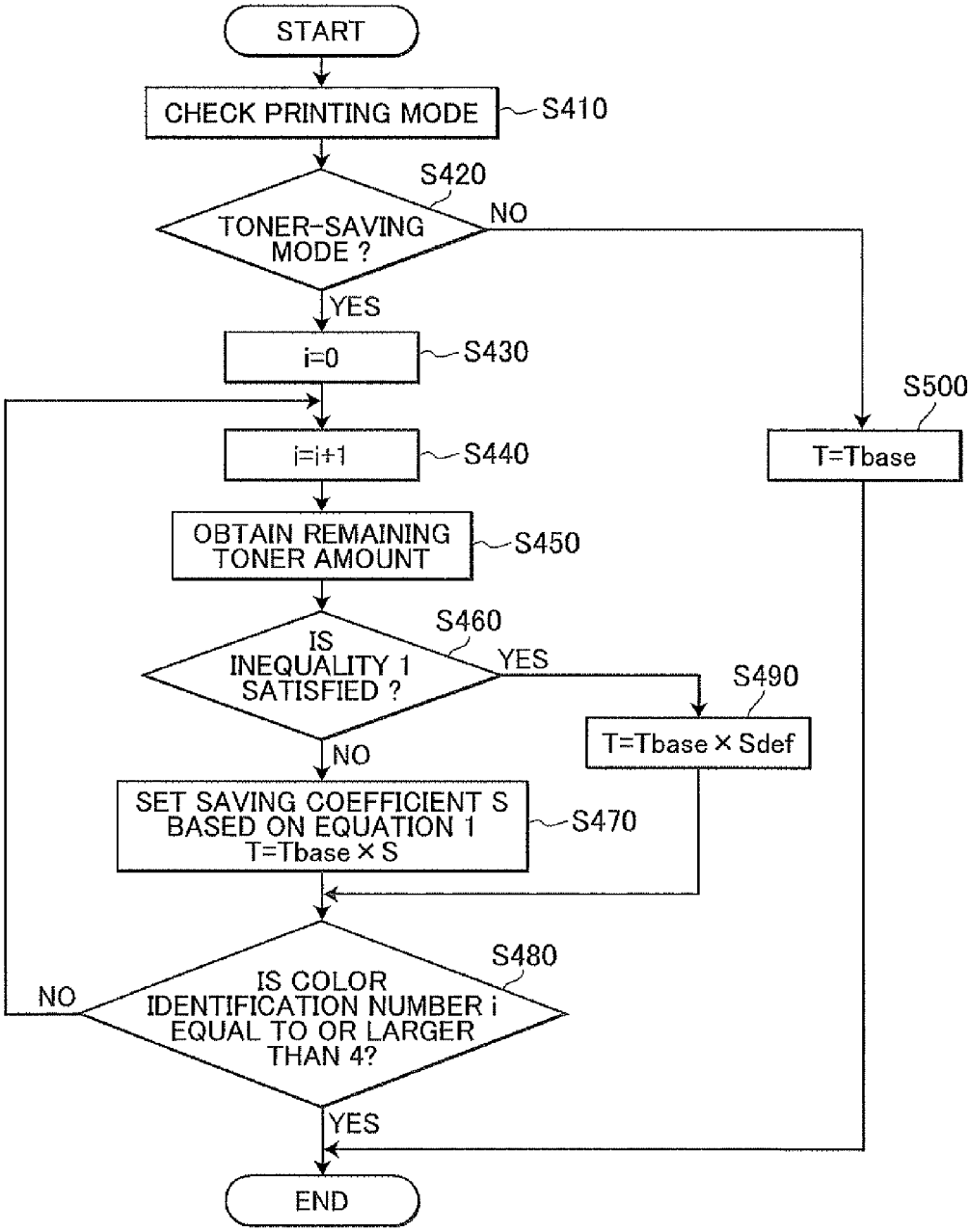
FIG. 12 is a flowchart showing a toner amount setting process according to a third embodiment of the invention.

Referring to the flowchart of FIG. 12, a description is given for a toner amount setting process according to a third embodiment to be performed by the control unit 201. In S410 the control unit 201 determines which mode is set for printing, either the normal mode or the toner-saving mode.

In S420, if the toner-saving mode is set for printing (S420: Yes), the process proceeds to S430. If the normal mode is set (S420: No), the process proceeds to S500.

In S430, a color identification number i is set to 0. For the color identification number i, the value 1 corresponds to the color C, 2 to M, 3 to Y, and 4 to K. In S440, the color identification number i is incremented by 1.

In S450 the control unit 201 obtains the toner remaining amount Rt at that point in time, for the toner having the color corresponding to the current color identification number i.

Specifically, the control unit 201 obtains the toner remaining amount Rt by subtracting the cumulative use amount Tuse stored in the RAM 207 from the toner capacity Tmax stored in the ROM 205.

In S460 the control unit 201 determines whether Inequality 1 is satisfied for the toner having the color corresponding to the color identification number i. If Inequality 1 is not satisfied (S460: No), the process proceeds to S470.

$$Rt \leqq T\text{base} \times Sdef \times (P\text{max} - Pttl) \quad \text{(Inequality 1)}$$

In S470, the control unit 201 obtains the value of the saving coefficient S based on Equation 1, for the toner having the color corresponding to the color identification number i. The control unit 201 sets the toner amount set value T to a value obtained by multiplying the base toner amount Tbase by the saving coefficient S.

$$S = Rt / \{T\text{base} \times (P\text{max} - Pttl)\} \quad \text{(Equation 1)}$$

If in S460 the control unit 201 determines that Inequality 1 is satisfied (S460: Yes), the process proceeds to S490. The control unit 201 sets the saving coefficient S to the default saving coefficient Sdef for the toner having the color corresponding to the color identification number i. The control unit 201 then sets the toner amount set value T (an amount of toner to be consumed per one sheet) to a value obtained by multiplying the base toner amount Tbase by the default saving coefficient Sdef.

In S480 the control unit 201 determines whether the color identification number i has reached 4 (whether all the colors CMYK of toner have gone through S440 through S470 and S490). If so (S480: Yes), the process ends. If not (S480: No), the process returns to S440. Note that values of the base toner amount Tbase may differ depending on the color.

In this embodiment, the saving coefficient S is determined individually for each of the CMYK colors. Thus, for example, even when there are differences among the respective remaining toner amounts, an appropriate saving coefficient S can be determined for each color, thereby reducing the remaining toner amount when the toner cartridge 60 is replaced.

According to the above-described embodiments, it is possible to prevent toner from being wasted and to prevent toner from being left in the toner cartridge to be replaced. Therefore, there is no concern that remaining toner leaks from the inside of the replaced toner cartridge to the outside. Further, recycling process for recycling the toner cartridge can be made easier.

While the invention has been described in detail with reference to the above aspects thereof, it would be apparent to those skilled in the art that various changes and modifications may be made therein without departing from the scope of the claims.

For example, the saving coefficient S set in S150 of the first embodiment, the saving coefficient S set in S270 of the second embodiment, or the saving coefficient S set in S470 of the third embodiment is not limited to the value determined based on Equation 1. Other values within the range satisfying Inequality 2 may be used. For example, a plurality of degrees for toner saving are predetermined (stored in the ROM 205), so that a user can select one from the plurality of degrees. Alternatively, the control unit 201 may perform this selection. More specifically, the saving coefficient S in which toner saving is performed most greatly (strongly) is set to the default saving coefficient Sdef. Other values of the saving coefficient S are set incrementally so that the values of the saving coefficient S approach 100% (printing in the normal mode). Assuming that the plurality of degrees of toner saving includes five degrees, the values of the saving coefficient S are set like Sdef=50%, Sdef2=60%, Sdef3=70%, Sdef4=80%, and Sdef5=90%. Here, the saving coefficients Sdef2, Sdef3, Sdef4, and Sdef5 greater than the saving coefficient S obtained by Equation 1 cannot be selected. That is, if the saving coefficient S obtained by Equation 1 is 85%, Sdef5 cannot be selected. In this case, one of four degrees of toner saving (Sdef, Sdef2, Sdef3, and Sdef4) can be selected. The number of degrees of toner saving that can be selected varies depending on operating situations of the printer. In this modification, the remaining toner amount can be reduced more greatly than in the case where the default saving coefficient Sdef is constantly used as the saving coefficient S in the toner-saving mode, thereby preventing toner from being wasted.

$$Sdef < S \leqq Rt / \{T\text{base} \times (P\text{max} - Pttl)\} \quad \text{(Inequality 2)}$$

Figure 13A:
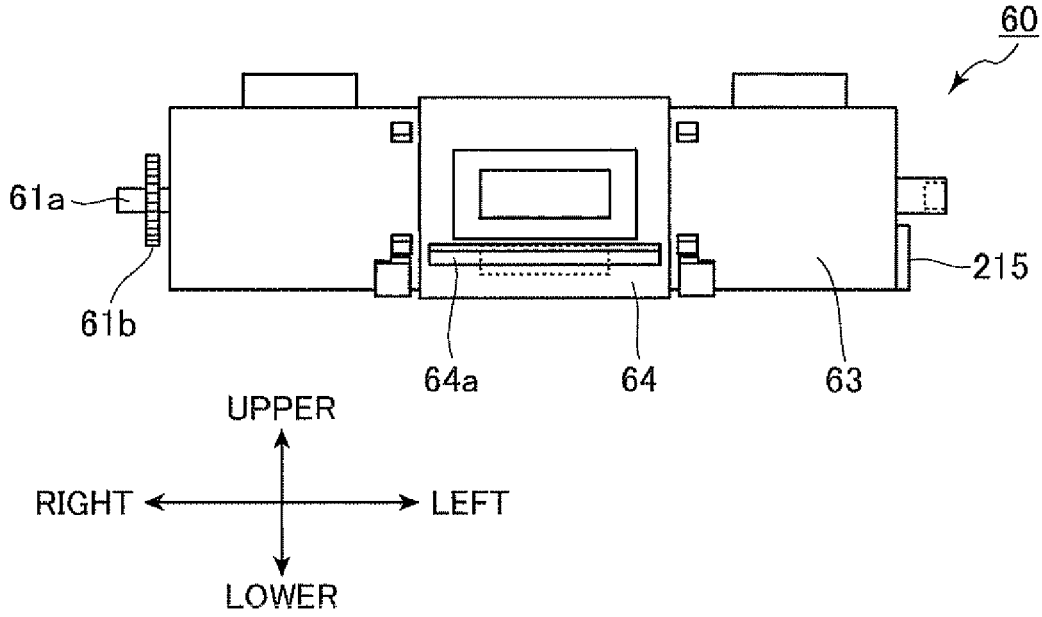
FIG. 13A is a rear view of a toner cartridge according to a modification.
Figure 13B:
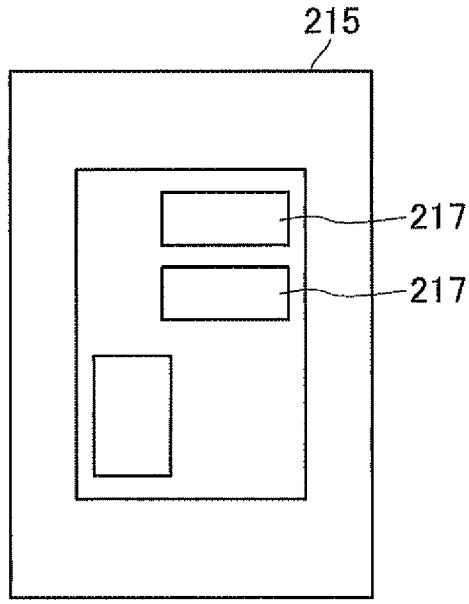
FIG. 13B is an enlarged view of a toner information chip provided to the toner cartridge shown in FIG. 13A.

Further, as shown in FIG. 13A, the toner cartridge 60 may include a toner information chip 215 on the left side thereof, instead of the first new-toner-cartridge check gear 162 and the second new-toner-cartridge check gear 163. The toner information chip 215 stores information (data) including a counterfeit prevention authorization ID, a toner type, a new/used determination flag, and a cumulative number of printed sheets. As shown in FIG. 13B, the toner information chip 215 includes contact terminals 217. The contact terminals 217 are connected to the control unit 201 via a terminal (not shown) provided inside the casing 2 of the laser printer 1. As the toner cartridge 60 is mounted to the casing 2 of the laser printer 1, the control unit 201 accesses the new/used determination flag stored in the toner information chip 215, so as to determine whether the toner cartridge 60 is new or used. If the control unit 201 determines that the mounted toner cartridge 60 is new, the cumulative use amount Tuse and the cumulative number of printed sheets Pttl are reset to zero. After that, when printing is performed with the toner cartridge 60, the control unit 201 sets the new/used determination flag stored in the toner information chip 215 to "used".

Figure 14A:
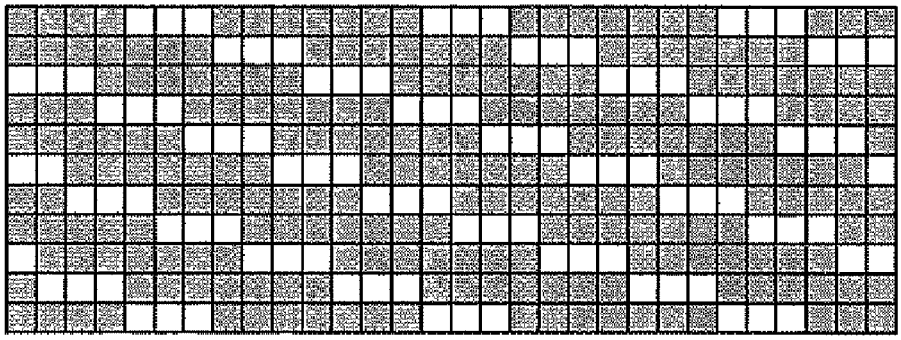

In the first through third embodiments, the method for adjusting the toner amount by the control unit 201 according to the value set in the toner amount setting process may be modified as follows. FIG. 14A is an explanatory diagram showing image data on which a monochrome-conversion process (or color-matching process) and a toner-saving process have been performed sequentially. In FIG. 14A, each cell represents one pixel, where filled cells represent pixels in a dot-ON state by binarization and non-filled cells represent pixels in a dot-OFF state.

Figure 14B:
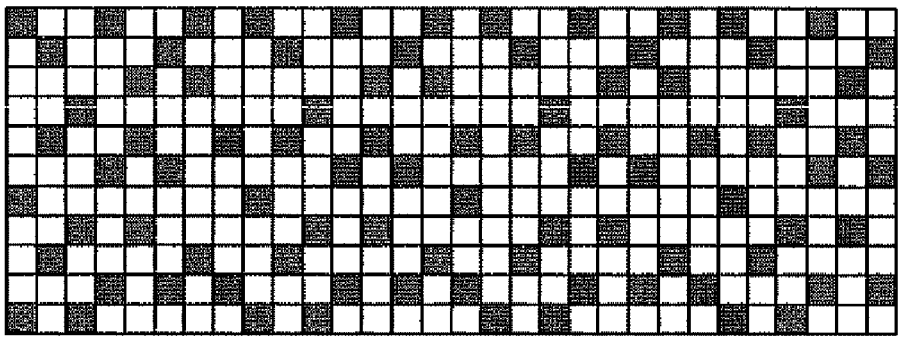
Figure 14C:
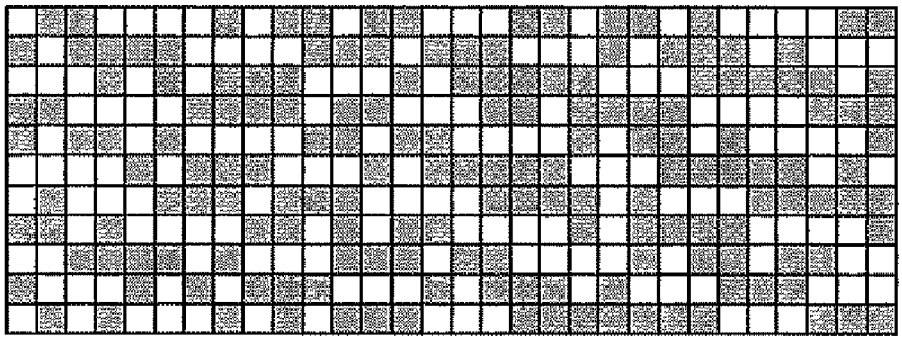

FIG. 14B shows a mask pattern including units in a one-to-one correspondence with pixels in image data. For example, if the saving coefficient S is set to a value of 0.7, the image data shown in FIG. 14A is thinned out by the mask having a pattern for bringing 30% of the entire units into the OFF state. As a result, the image data shown in FIG. 14A is thinned out by 30% (pixels in the dot-ON state are changed to the dot OFF state), so as to generate new image data as shown in FIG. 14C. For color image data, the same process is performed on each color.

The above-described mask pattern needs to be changed according to the saving coefficient S. The mask pattern may be generated by computation performed by the control unit 201 according to the saving coefficient S. Alternatively, a plurality of mask patterns may be stored in the ROM 205 in accordance with predetermined saving coefficient values so that one of the mask patterns is selected based on the set value of the saving coefficient S.

What is claimed is:

1. An image forming apparatus comprising:

a main body;

a developer accommodating unit that is configured to accommodate developer and that is detachably mounted in the main body;

an image forming unit that forms an image on a surface of a recording medium with the developer;

a mode setting portion that sets a mode to either one of:

a normal mode in which a developer amount set value T is set to a base developer amount Tbase, the developer amount set value T being an amount of developer consumed for forming an image on a single sheet of the recording medium; and a developer-saving mode in which the developer amount set value T is set to a value smaller than the base developer amount Tbase based on a saving coefficient S, the saving coefficient S being greater than zero and smaller than one;

a parameter obtaining portion that obtains both a cumulative number of printed sheets Pttl that is a cumulative number of sheets of the recording medium on which an image is formed since the developer accommodating unit is mounted in the main body, and a developer remaining amount Rt that is an amount of developer remaining in the developer accommodating unit;

a determining portion that determines in the developer-saving mode whether a first inequality $$Rt \leqq T\text{base} \times Sdef \times (P\text{max} - Pttl)$$

is satisfied, where a default saving coefficient Sdef is a default value of the saving coefficient S, and a maximum number of printable sheets Pmax is a maximum number of printable sheets that is preset for the developer accommodating unit; and a saving-coefficient setting portion that sets the saving coefficient S to the default saving coefficient Sdef if the determining portion determines that the first inequality is satisfied, and that sets the saving coefficient S to a value satisfying a second inequality $$Sdef < S \leqq Rt/\{T\text{base} \times (P\text{max} - Pttl)\}$$

if the determining portion determines that the first inequality is not satisfied.

2. The image forming apparatus according to claim 1, wherein the saving-coefficient setting portion sets the saving coefficient S to a value satisfying an equation $$S = Rt/\{T\text{base} \times (P\text{max} - Pttl)\}$$

if the determining portion determines that the first inequality is not satisfied.

3. The image forming apparatus according to claim 2, wherein the developer accommodating unit comprises a plurality of developer accommodating units provided for respective ones of a plurality of colors;

wherein the image forming unit comprises a plurality of image forming units that form images in respective ones of the plurality of colors;

wherein the parameter obtaining portion detects the developer remaining amount Rt for each of the plurality of colors;

wherein the determining portion determines whether the first inequality is satisfied for each of the plurality of colors; and wherein the saving-coefficient setting portion calculates the saving coefficient S for each of the plurality of colors, and selects a smallest value from values of the saving coefficient S for the plurality of colors as the saving coefficient S used commonly for all of the plurality of colors.

4. The image forming apparatus according to claim 2, wherein the developer accommodating unit comprises a plurality of developer accommodating units provided for respective ones of a plurality of colors;

wherein the image forming unit comprises a plurality of image forming units that form images in respective ones of the plurality of colors;

wherein the parameter obtaining portion detects the developer remaining amount Rt for each of the plurality of colors;

wherein the determining portion determines whether the first inequality is satisfied for each of the plurality of colors; and wherein the saving-coefficient setting portion sets the saving coefficient S for each of the plurality of colors.

5. The image forming apparatus according to claim 1, wherein the parameter obtaining portion calculates a cumulative use amount Tuse that is an amount of developer that is cumulatively consumed since the developer accommodating unit is mounted in the main body, based both on the cumulative number of printed sheets Ptt1 and on the developer amount set value T; and wherein the parameter obtaining portion obtains the developer remaining amount Rt by subtracting the cumulative use amount Tuse from a developer capacity Tmax, the developer capacity Tmax being a developer capacity that is preset for the developer accommodating unit.

6. The image forming apparatus according to claim 1, wherein, in the developer-saving mode, the developer amount set value T is obtained by multiplying the base developer amount Tbase by the saving coefficient S.

7. The image forming apparatus according to claim 1, wherein, in the developer-saving mode, a developer amount is adjusted by thinning out image data using a mask pattern for changing a predetermined ratio of dots in the image data from an ON state to an OFF state, the predetermined ratio being determined by the saving coefficient S.

8. The image forming apparatus according to claim 1, further comprising a storage section that stores a plurality of predetermined saving coefficients, wherein the saving-coefficient setting portion sets the saving coefficient S by selecting one satisfying the second inequality from the plurality of predetermined saving coefficients, if the determining portion determines that the first inequality is not satisfied.

9. The image forming apparatus according to claim 1, wherein the developer is toner.

10. An image forming apparatus comprising:

a main body;

a developer accommodating unit that is configured to accommodate developer and that is detachably mounted in the main body;

an image forming unit that forms an image on a surface of a recording medium with the developer;

a mode setting portion that sets a mode to either one of:

a normal mode in which a developer amount set value T is set to a base developer amount Tbase, the developer amount set value T being an amount of developer consumed for forming an image on a single sheet of the recording medium; and a developer-saving mode in which the developer amount set value T is set to a value smaller than the base developer amount Tbase based on a saving coefficient S, the saving coefficient S being greater than zero and smaller than one;

a parameter obtaining portion that obtains both a cumulative number of printed sheets Pttl that is a cumulative number of sheets of the recording medium on which an image is formed since the developer accommodating unit is mounted in the main body, and a developer remaining amount Rt that is an amount of developer remaining in the developer accommodating unit;

a determining portion that determines in the developer-saving mode whether the developer runs out before the cumulative number of printed sheets Pttl reaches a maximum number of printable sheets Pmax, the maximum number of printable sheets Pmax being a maximum number of printable sheets that is preset for the developer accommodating unit; and a saving-coefficient setting portion that sets the saving coefficient S to a default saving coefficient Sdef if the determining portion determines that the developer runs out before the cumulative number of printed sheets Pttl reaches the maximum number of printable sheets Pmax, the default saving coefficient Sdef being a default value of the saving coefficient S, and that sets the saving coefficient S to a value larger than the default saving coefficient Sdef if the determining portion determines that the cumulative number of printed sheets Pttl reaches the maximum number of printable sheets Pmax in a state where the developer is left in the developer accommodating unit.

11. The image forming apparatus according to claim 10, wherein the saving-coefficient setting portion sets the saving coefficient S to the value larger than the default saving coefficient Sdef so that the developer remaining amount Rt theoretically becomes zero when the cumulative number of printed sheets Pttl reaches the maximum number of printable sheets Pmax if the determining portion determines that the cumulative number of printed sheets Pttl reaches the maximum number of printable sheets Pmax in a state where the developer is left in the developer accommodating unit.

12. A computer readable product storing a set of program instructions executable on an image forming apparatus, the set of program instructions comprising:

setting a mode for printing to either one of:

a normal mode in which a developer amount set value T is set to a base developer amount Tbase, the developer amount set value T being an amount of developer consumed for forming an image on a single sheet of a recording medium; and a developer-saving mode in which the developer amount set value T is set to a value smaller than the base developer amount Tbase based on a saving coefficient S, the saving coefficient S being greater than zero and smaller than one;

obtaining both a cumulative number of printed sheets Pttl that is a cumulative number of sheets of the recording medium on which an image is formed since a developer accommodating unit is mounted in a main body of the image forming apparatus, and a developer remaining amount Rt that is an amount of developer remaining in the developer accommodating unit;

determining in the developer-saving mode whether a first inequality $$Rt \leqq T\mathrm{base} \times Sdef \times (P\mathrm{max} - Pttl)$$

is satisfied, where a default saving coefficient Sdef is a default value of the saving coefficient S, and a maximum number of printable sheets Pmax is a maximum number of printable sheets that is preset for the developer accommodating unit; and setting the saving coefficient S to the default saving coefficient Sdef if the first inequality is satisfied, and setting the saving coefficient S to a value satisfying a second inequality $$Sdef < S \leqq Rt / \{T\mathrm{base} \times (P\mathrm{max} - Pttl)\}$$

if the first inequality is not satisfied.

* * * * *